United States Patent [19]

Schankman

[11] 3,964,403

[45] June 22, 1976

[54] THREE-WAY TABLE

[75] Inventor: Milton Schankman, Valley Stream, N.Y.

[73] Assignee: Stakmore Co., Inc., New York, N.Y.

[22] Filed: Dec. 23, 1974

[21] Appl. No.: 535,791

[52] U.S. Cl. ..... 108/90; 108/62

[51] Int. Cl.[2] ..... A47B 13/08

[58] Field of Search ..... 108/90, 111, 152, 112, 108/93, 97, 62, 150, 159, 78, 66; 248/250, 235

[56] References Cited

UNITED STATES PATENTS

| | | | |
|---|---|---|---|
| 905,026 | 11/1908 | Tritch et al. | 108/78 |
| 967,695 | 8/1910 | Whitney | 108/62 |
| 1,007,727 | 11/1911 | Onken | 108/90 |
| 1,949,869 | 3/1934 | MacDonald | 108/90 |
| 1,967,979 | 7/1934 | Stern | 108/62 X |
| 2,556,943 | 6/1951 | Reisman | 108/90 |
| 2,608,454 | 8/1952 | Slattery | 108/62 X |
| 3,057,483 | 10/1962 | Derman | 248/250 X |
| 3,265,344 | 8/1966 | Ornstein | 108/152 X |

*Primary Examiner*—James T. McCall
*Assistant Examiner*—Peter A. Aschenbrenner
*Attorney, Agent, or Firm*—Hopgood, Calimafde, Kalil, etc.

[57] ABSTRACT

This invention is a three-way table. It includes a folding table similar to a conventional card table but combined with means for attaching supports extending outwardly on all sides of the basic table. A conversion top can be placed on the table with one side up to provide a serving table with a finish such as polished wood or simulated wood. This convertible top can be turned upside down to provide a gaming table contoured for the particular game or games for which it is intended; for example with depressions for holding poker chips. The convertible top can be folded for more convenient storage.

10 Claims, 7 Drawing Figures

THREE-WAY TABLE

BACKGROUND AND SUMMARY OF THE INVENTION

This invention relates to convertible furniture; and more especially to a three way table which serves as a card table for two or four players; and when equipped with a convertible top as a serving or dining table for six or more. The convertible top has both upper and lower surfaces that can be used interchangeably depending upon the purpose for which the table is to be used at any particular time.

One surface is preferably a polished wood, or simulated wood, which can be used as a dining or serving table; and the other surface is preferably a gaming table contoured to adapt it for a particular game, for example with depressions for holding poker chips.

The outstanding advantage of the invention is that it provides a table which can be used by two or four persons with a card table area for play, or which can be used by six or eight persons, depending upon the size of the conversion top, for other purposes. In spite of this wide range of size to which the table can be adapted, it has the unusual feature of being capable of folding into a small storage space. It provides the combination of folding legs and a folding top in the same table and with extremely simple construction.

Another advantage of the invention is that it is possible to make the conversion quickly and with a minimum of inconvenience. This result is attained by having detachable supports located at angular positions around the table, preferably four supports attached to the respective side frames of a four-sided table and with flanges at the ends of the supports for holding the conversion top centered on the fixed top.

The conversion top is preferably made in two parts connected together along a hinge line by an "invisible hinge".

Other objects, features and advantages of the invention will appear or be pointed out as the description proceeds.

BRIEF DESCRIPTION OF DRAWINGS

In the drawing, forming a part hereof, in which like reference characters indicate corresponding parts in all the views.

DESCRIPTION OF PREFERRED EMBODIMENT

Figure 1:
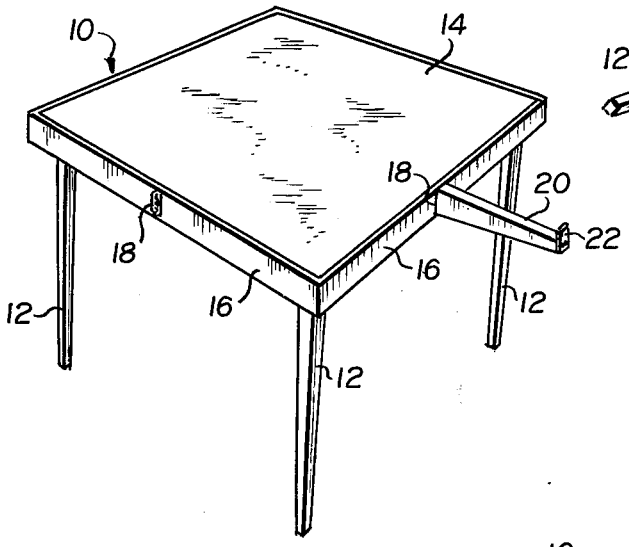
FIG. 1 is a perspective view of a table made in accordance with this invention and showing a support extending from one side frame of the table and showing a bracket for such a support on an adjacent side frame.
Figure 2:
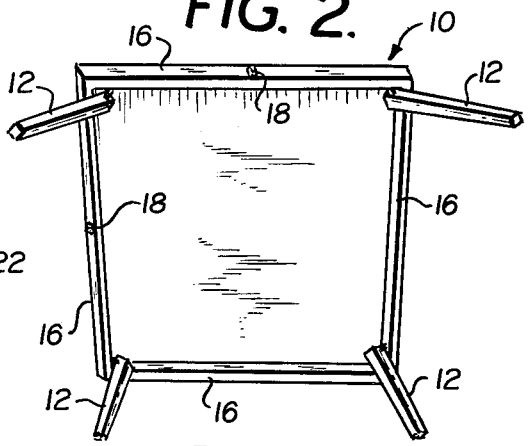
FIG. 2 is a bottom view of the table of FIG. 1 without any of the supports for the conversion top but showing two of the brackets that are used to connect the supports to the side frames of the table.

FIG. 1 shows a table 10 which is preferably a four-sided card table with legs 12 which are connected to the underside of a fixed top 14 by conventional hinges which permit the legs of the table to fold in against the bottom of the fixed top 14.

Around the perimeter of the top 14 there are side frames 16 which extend downwardly from a level substantially flush with the top surface of the fixed top 14. These side frames 16 meet at the corners of the table 10 and this construction is conventional.

In order to hold a conversion top in place over the fixed top 14, the table shown in FIG. 1 is equipped with brackets 18 located at angularly spaced regions around the perimeter of the fixed top 14. In the illustrated construction, these brackets 18 are located at mid regions of each of the side frames 16.

Each of the brackets 18 is constructed in such a way as to connect with a support 20 which extends from the bracket 18 in a direction substantially normal to the side frame to which the bracket is connected.

Figure 4:
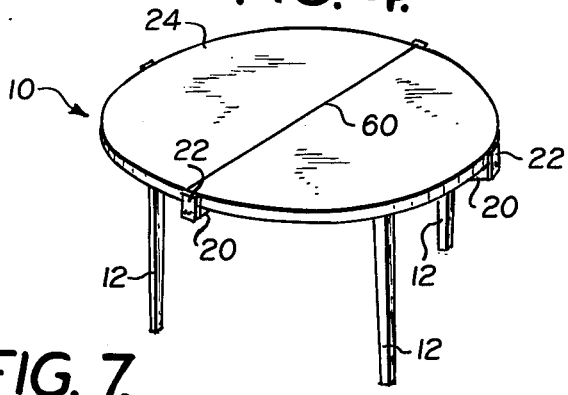
FIG. 4 is a perspective view showing the top of the table with the conversion top held in place by flange plates at the ends of the detachable supports, the scale of FIG. 4 being smaller than that of FIGS. 1 and 2.

Each of the supports 20 holds a flange or plate 22 spaced from the side frame 16 and in a position extending upward above the plane of the top surface of the fixed top 14. The plates 22 contact with the perimeter of a conversion top 24, as shown in FIG. 4, and reach upward across the edge of the perimeter of the conversion top 24 so as to prevent horizontal movement of the conversion top 24 with respect to the underlying fixed top. The plates 22 cooperate to hold the conversion top 22 centered on the fixed top.

In the preferred construction, each of the supports 20 has its top surface flush with the top surface of the fixed top 14, or the top surfaces of the side frames 16, if the latter extend somewhat above the plane of the fixed top 14.

Figure 3:
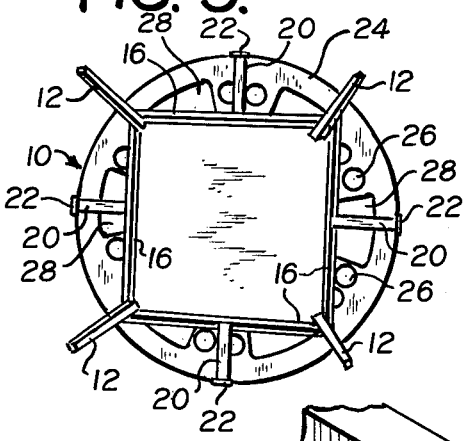
FIG. 3 is a view similar to FIG. 2, but on a smaller scale, and showing supports attached to all of the side frames of the table and showing a bottom view of the portion of the conversion top that extends beyond the edges of the fixed top.

With the conversion top 24 of round shape, all of the supports 20 can be of equal length for holding the conversion top 24 centered on the table 10 as shown in FIG. 3.

The conversion top 24 is shown with different surfaces on its opposite sides. For example, FIG. 4 shows the conversion top 24 with a smooth top surface which may be polished wood for use as a serving table or which may be simulated wood.

Figure 5:
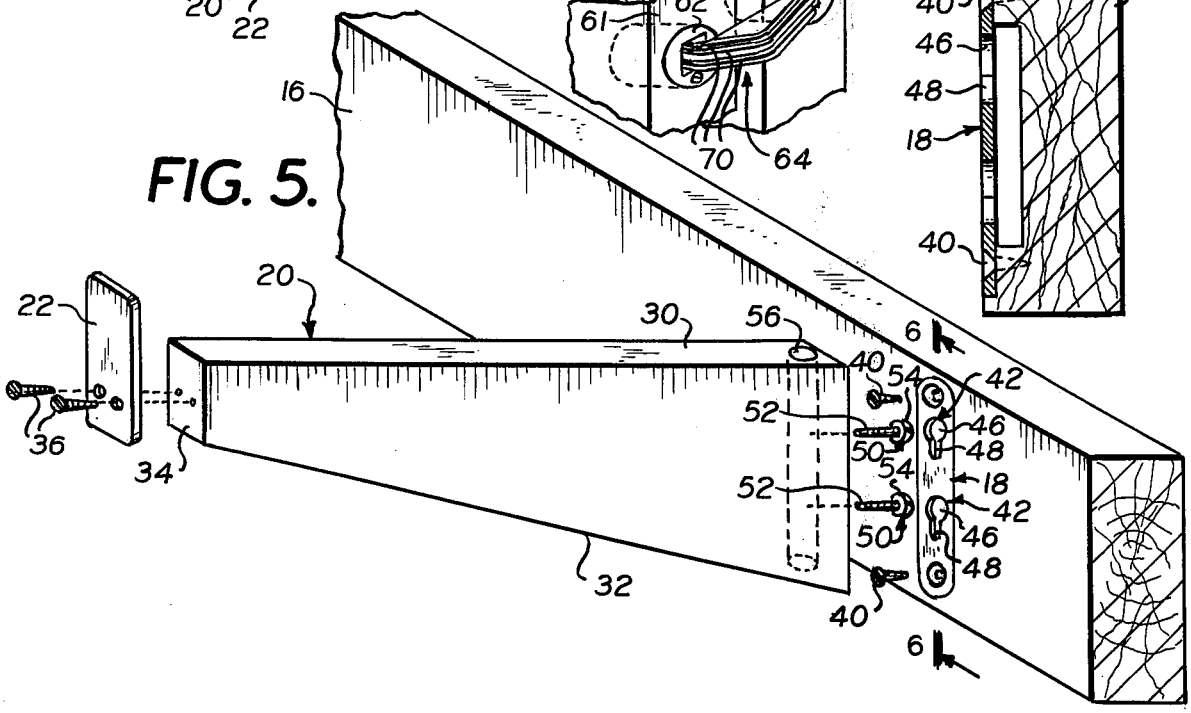
FIG. 5 is a greatly enlarged exploded view showing a portion of one of the side frames and one of the supports together with the bracket, flange plate and fastening means.

FIG. 5 shows the underside of the conversion top 24 with depressions 26 and 28 such as are used for poker tables. This gaming table surface may be contoured or otherwise surfaced for any particular games for which the underside of the conversion top 24 is intended.

Figure 6:
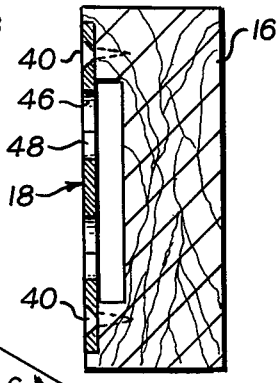
FIG. 6 is an enlarged sectional view taken on the lines 6—6 of FIG. 5.

FIGS. 5 and 6 show the detailed construction of one of the supports 20 and the bracket structure for connecting the support 20 to one of the side frames 16. The top surface of the support 20 is indicated by the reference character 30. In the preferred construction, the support 20 has a bottom face 32 which extends up toward its outer end so that the vertical dimension of the support 20 decreases as it extends outward. There is, however, an end face 34 of substantial area for connecting with the end flange or plate 22. In the illustrated construction the plate 22 is rigidly held against the end face 34 of the support 20 by screws 36.

The bracket 18 is preferably a metal plate which is recessed into the side frame 16, as shown in FIG. 6. This recess is preferably shaped to the contour of the bracket 18 and the bracket is held in the recess by countersunk screws 40 which thread into the side frame 16.

The support 20 is connected with the bracket 18 by detachable fastening means which permit the support 20 to be connected and disconnected quickly and conveniently. In the construction illustrated, there are two keyways 42 opening through the bracket 18.

Each keyway 42 includes a generally circular opening 46 with a slot 48, of substantially less width than the opening 46 and extending downwardly therefrom. The support 20 is connected with the bracket 18 by screws 50. These screws thread into the end face of the support 20 which confronts the side frame 16 of the fixed table top. Each of the screws 50 has a shank portion 52 and a round head 54 which is of larger diameter than the shank portion so that there is a shoulder where the shank portion 52 joins the head 54.

The screws 50 are screwed only part way into the end face of the support 20 so that there is a clearance between the shoulder of the screw and the end face of the support 20. This clearance is equal to or slightly greater than the thickness of the strip material of which the bracket 18 is made.

In order to attach the support 20 to the side frame 16, the heads 54 of the screws 50 are inserted through the circular opening 46 of the keyways 42 far enough to bring the inner end face of the support 20 into contact with the outside surface of the bracket 18. The support 20 is then pushed downward so that the shank 52 of the screws 50 move down into the slots 48 which are preferably of the same width, or slightly greater width, as the shanks 52 in the region adjacent to the heads of the screws. Since the screw heads 54 are substantially wider than the slots 48, the bracket 18 holds the screws, and the support 20, firmly connected to the side frame 16.

When the conversion top is not in use, the supports 20 can be quickly and conveniently removed from the side frame 16 by merely exerting an upward pull on the supports 20 to bring the screw heads 50 into alignment with the circular openings 46, and the support 20 can then be moved horizontally out of engagement with the bracket 18.

In order to provide for more convenient storage of the conversion table top, it can be constructed in two parts which join together along a hinge line (FIG. 4) with the parts connected by an invisible hinge. Such hinges are well known in the furniture art and no description of such a hinge is necessary for a complete understanding of this invention.

When the support 20 is made of wood, the grain of the wood extends lengthwise of the support. In order to prevent the shanks 52 of the screws 50 from screwing into end grain, a dowel 56 is inserted into the support 20 near the inner end face of the support and in such position that the screw shanks 52 screw into the dowel 56. Since the grain of the dowel extends in the direction of the length of the dowel and substantially at right angles to the top face 30 of the support 20, the shanks 52 screw into the cross grain of the dowel 56 and provide a much stronger connection between the screws 50 and support 20 than would be possible if they screwed into end grain or a wooden support 30.

In order to connect the two sections of the convertible top 24 together, without having the hinge show regardless of which surface is uppermost, invisible hinges are preferably used to connect the parts together. Such hinges have been used for cabinet doors of good furniture but the combination of such hinges with a table top to make the hinge invisible, regardless of which surface of the table top is uppermost, is believed to be novel.

Figure 7:
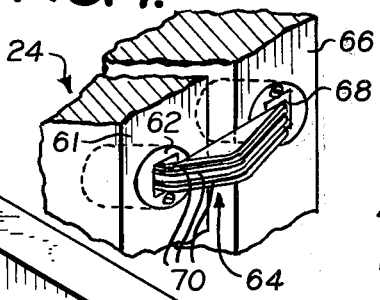
FIG. 7 is a detail view showing an invisible hinge for folding the conversion top.

FIG. 7 shows a portion of the length of the conversion top 24, and indicated by the reference character 61, connected to one side 62 of an invisible hinge 64. The other side of the table top 24, indicated by the reference character 66, is connected to another side 68 of the invisible hinge 64.

The sides 62 and 68 are cylindrical and are recessed into the panels 61 and 66 which confront one another when the table top is in a flat condition and the diametric faces of the panels 61 and 66 are confronting one another and in substantial contact with one another. Connecting plates 70 which pivot and slide with respect to the cylindrical portions 62 and 68 connect the opposite sides of the hinges together and provide the hinge movement. These plates 70 slide into recesses in the respective sides 62 and 68 as the sections of the table top 24 move into alignment with one another. There are a plurality of hinges 64 at spaced locations along the diameter on which the table top 24 folds. These invisible hinges are well-known in the furniture field and can be purchased from the Otto Gerdau Co. of 82 Wall Street, New York, N.Y. 10005.

The preferred embodiment of the invention has been illustrated and described, but changes and modifications can be made and some features can be used in different combinations without departing from the invention as defined in the claims.

What is claimed is:

1. A convertible table combination having three alternatively usable table tops, said combination including a basic table structure with a fixed top portion having a table top as a permanent part thereof, and legs connected with the fixed top portion for supporting said structure from a floor or other underlying support, a conversion top that fits over the fixed top portion extending beyond the perimeter of the fixed top portion, the conversion top having opposite surfaces, either of which can rest on the fixed top portion and either of which is used as the top surface of the table, when the opposite surface rests on said fixed top portion, each of said opposite surfaces of the conversion top having different surface treatment in accordance with its intended use and one of the surfaces of the conversion top having a surface treatment that makes it a game table, the conversion top comprising hinged panels that fold together when not in use to reduce its size for storage, said panels having edge faces confronting one another and substantially in contact with one another when the conversion top is unfolded and the panels are in alignment with one another, and invisible hinges recessed into said edge faces and securing the panels to one another, said hinges being hidden from view when the conversion top is unfolded and either surface of the conversion top is uppermost, and the invisible hinges having sliding and pivotal portions that move far enough to bring the sections into substantially parallel relation with one another when said panels are folded into parallel relation with one another, the fixed top portion having supports movably attached thereto and extending outwardly therefrom under the conversion top, and restraining elements at the outer ends of the supports in position to extend upward at angularly spaced locations and into contact with the perimeter of the conversion top for holding the conversion top against horizontal movement with respect to the fixed top.

2. The convertible table described in claim 1 characterized by the fixed top portion including a table top of polygonal shape and the conversion top having a rounded shape.

3. The convertible table described in claim 1 characterized by side frames around the perimeter of the fixed top portion, brackets secured to the side frames at angularly spaced locations around said perimeter, the supports being detachably connected with the brackets and extending outward from the side frames, and the supports extending from the side frames as far as the conversion top extends beyond the fixed top portion.

4. The convertible table described in claim 3 characterized by the fixed table top being square, and the conversion top being round and of a diameter as great as the diagonal of the square fixed top, and the brackets for the supports being located at mid regions of each of the side frames, and all of the supports being of equal length for holding the conversion top centered on the fixed top.

5. The convertible table described in claim 4 characterized by the brackets being parts permanently connected with the side frames and having keyways formed therein, and each of the brackets having projections at its inner end that lock into the keyways to detachably secure the support to its bracket.

6. The convertible table described in claim 1 characterized by one side of the conversion top being a poker table with depressions therein for poker chips.

7. The convertible table described in claim 1 characterized by the basic table structure being a card table with four folding legs on the underside thereof, side frames around the perimeter of the fixed top portion, brackets secured to the side frames at angularly spaced locations around said perimeter, supports detachably connected with the brackets and extending outward from the side frames, and with the brackets located at the mid portion of each of the sides of the card table.

8. A convertible table including a basic table with a fixed top, folding legs connected with the basic table top for supporting it from a floor or other underlying support, when the legs are extended, and lying substantially parallel to and adjacent to the fixed top when folded for storing the table, side frames around the perimeter of the fixed top, brackets secured to the side frames at angularly spaced locations around said perimeter, supports detachably connected with the brackets and extending outward from the side frames, a conversion top of larger area than the fixed top and that fits over the fixed top and supports, the connection top comprising hinged panels that fold together when not in use to reduce its area for storage, and restraining elements at the outer ends of the supports in position to extend upward at the angularly spaced locations and into contact with the perimeter of the conversion top for holding the conversion top against horizontal movement with respect to the fixed top, and characterized by each of the supports being made of wood with grain extending lengthwise of the support, wooden dowels in the supports adjacent to the inner ends thereof and with grain extending transverse of the length of said supports, each support having two screws threaded through an inner end face of the support, each screw having a shank portion threaded into the cross grain ofone of said dowels, and a head that is spaced some distance from said inner end face, each of the brackets having two keyways, each of which includes a circular opening large enough for one of the screw heads to pass therethrough, and a downwardly extending slot portion of a width greater than that of the shank of the screw and substantially less than the width of the head of the screw.

9. The convertible table described in claim 8 characterized by each bracket being a metal strip recessed into a side frame of the fixed table top, flat head screws that hold the strip secured to the side frame, there being clearance between the back of the strip and the confronting face of the side frame for receiving the heads of the screws that project from the inner end face of each support and clearance for downward movement of the support screws to the bottom of the slot.

10. The convertible table described in claim 1 characterized by side frames around the perimeter of the fixed top portion, brackets secured to the side frames at angularly spaced locations around said perimeter, supports detachably connected with the brackets and extending outward from the side frames, each of the supports having a flat top surface that is flush with the fixed top of the table when the support is connected to its bracket, the inner end of each support having a height substantially equal to that of the side frame and having a bottom surface that slopes upward toward the outer end of the support, and end face at the outer end of the support extending in a plane substantially normal to the top surface of the support, a plate secured to the outer end face of the support and extending upward above said outer end face for a distance substantially equal to the height of the outer perimeter of the conversion top, said plate constituting the restraining element.

* * * * *